US011225959B2

(12) United States Patent
Bergman et al.

(10) Patent No.: US 11,225,959 B2
(45) **Date of Patent: *Jan. 18, 2022**

(54) CYLINDER HEAD ASSEMBLY FOR RECIPROCATING COMPRESSOR

(71) Applicant: Emerson Climate Technologies, Inc., Sidney, OH (US)

(72) Inventors: Ernest R. Bergman, Yorkshire, OH (US); Brian G. Schroeder, Sidney, OH (US); Michael R. Schultz Navara, Oakwood, OH (US); Adam Michael Blake, Troy, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 235 days.

This patent is subject to a terminal disclaimer.

(21) Appl. No.: 16/551,054

(22) Filed: Aug. 26, 2019

(65) Prior Publication Data

US 2019/0376501 A1 Dec. 12, 2019

Related U.S. Application Data

(63) Continuation of application No. 15/270,458, filed on Sep. 20, 2016, now Pat. No. 10,436,187.
(Continued)

(51) Int. Cl.
*F04B 39/12* (2006.01)
*F04B 53/10* (2006.01)
(Continued)

(52) U.S. Cl.
CPC ..... *F04B 39/125* (2013.01); *F04B 39/064* (2013.01); *F04B 39/1066* (2013.01);
(Continued)

(58) Field of Classification Search
CPC ..... F04B 39/1033; F04B 39/1066; F04B 39/1073; F04B 39/1086; F04B 39/108;
(Continued)

(56) References Cited

U.S. PATENT DOCUMENTS 1,739,603 A * 12/1929 McCune ..... F04B 39/1013 137/542
2,143,399 A 1/1939 Abercrombie
(Continued)

FOREIGN PATENT DOCUMENTS

CN 101809287 A 8/2010
CN 206386273 U 8/2017
(Continued)

OTHER PUBLICATIONS

International Search Report regarding International Application No. PCT/US2008/011400, dated Feb. 4, 2009.
(Continued)

*Primary Examiner* — Kenneth J Hansen
(74) *Attorney, Agent, or Firm* — Harness, Dickey & Pierce, P.L.C.

(57) ABSTRACT

A compressor may include a housing, a piston, a valve plate, a discharge valve and a head cover. The housing defines a cylinder. The piston is disposed within the housing and is movable within the cylinder. The valve plate is mounted to the housing and may include a discharge passage extending through the valve plate and defined by a discharge valve seat. The discharge valve is movable between a first position in which the discharge valve is seated on the discharge valve seat to restrict fluid flow through the discharge passage and a second position in which the discharge valve is spaced apart from the discharge valve seat to allow fluid flow
(Continued)

through the discharge passage. The head cover may include a guide post including a pocket that receives a valve stem of the discharge valve.

18 Claims, 6 Drawing Sheets

Related U.S. Application Data

(60) Provisional application No. 62/248,037, filed on Oct. 29, 2015.

(51) Int. Cl.
*F04B 39/10* (2006.01)
*F04B 39/06* (2006.01)
*F04B 39/14* (2006.01)

(52) U.S. Cl.
CPC ..... *F04B 39/1073* (2013.01); *F04B 39/1086* (2013.01); *F04B 39/121* (2013.01); *F04B 39/122* (2013.01); *F04B 39/14* (2013.01); *F04B 53/103* (2013.01)

(58) Field of Classification Search
CPC ..... F04B 39/125; F04B 39/102; F04B 39/10; F04B 39/1013; F04B 39/0055; F04B 53/03; F04B 53/007; F04B 53/10; F04B 53/1022; F04B 53/1025; F04B 53/1032; F04B 53/1087; F04B 53/109; F04B 27/0839; F04B 27/0843; F16K 15/08; F16K 15/14; F16K 15/06; F16K 15/026
See application file for complete search history.

(56) References Cited

U.S. PATENT DOCUMENTS

| | | | | |
|---|---|---|---|---|
| 2,449,408 | A | 9/1948 | Naab | |
| 2,613,870 | A | 10/1952 | Borgerd | |
| 2,728,351 | A | 12/1955 | Cooper | |
| 4,275,999 | A | 6/1981 | Hetzel et al. | |
| 4,470,774 | A | 9/1984 | Chambers | |
| 4,478,243 | A | 10/1984 | King | |
| 4,548,234 | A | 10/1985 | Prenger | |
| 4,642,037 | A | 2/1987 | Fritchman | |
| 4,685,489 | A | 8/1987 | Yun et al. | |
| 4,811,757 | A | 3/1989 | Brandt | |
| 4,854,839 | A | 8/1989 | DiFlora | |
| 5,073,146 | A | 12/1991 | Beck | |
| 5,171,137 | A | 12/1992 | Todescat et al. | |
| 5,197,867 | A | 3/1993 | Kandpal | |
| 5,247,912 | A | 9/1993 | Boyesen et al. | |
| 5,586,874 | A | 12/1996 | Hashimoto et al. | |
| 5,727,770 | A | 3/1998 | Dennis | |
| 5,960,825 | A | 10/1999 | Scancarello et al. | |
| 6,016,833 | A | 1/2000 | Spurny et al. | |
| 6,044,862 | A | 4/2000 | Schumann et al. | |
| 6,095,484 | A | 8/2000 | Frenkel | |
| 6,102,680 | A | 8/2000 | Fraser et al. | |
| 6,116,874 | A | 9/2000 | Nation et al. | |
| 6,149,400 | A | 11/2000 | Samland et al. | |
| 6,164,334 | A | 12/2000 | Wallis | |
| 6,254,357 | B1 | 7/2001 | Lynn et al. | |
| 6,345,965 | B1 | 2/2002 | Sagar | |
| 6,382,927 | B1 | 5/2002 | Sonobe et al. | |
| 6,431,845 | B1 | 8/2002 | Thomas et al. | |
| 6,530,760 | B1 | 3/2003 | Graber et al. | |
| 6,565,336 | B1 | 5/2003 | Fraser et al. | |
| 6,767,195 | B2 | 7/2004 | Lee | |
| 6,823,891 | B2 | 11/2004 | Schulze et al. | |
| 6,840,271 | B2 | 1/2005 | Obara et al. | |
| 7,040,877 | B2 | 5/2006 | Bergman et al. | |
| 7,214,040 | B2 | 5/2007 | Froeslev et al. | |
| 7,318,709 | B2 | 1/2008 | Koelzer et al. | |
| 7,364,413 | B2 | 4/2008 | Nieter | |
| 7,390,176 | B2 | 6/2008 | MacBain et al. | |
| 8,197,240 | B2 | 6/2012 | Obara et al. | |
| 2004/0052665 | A1 | 3/2004 | Izawa et al. | |
| 2004/0163713 | A1 | 8/2004 | Schulze et al. | |
| 2004/0164268 | A1 | 8/2004 | Obara et al. | |
| 2004/0166006 | A1* | 8/2004 | Bergman | F04B 39/1066 417/567 |
| 2004/0202562 | A1 | 10/2004 | Grassbaugh et al. | |
| 2005/0047928 | A1 | 3/2005 | Koelzer et al. | |
| 2005/0074351 | A1 | 4/2005 | Kultgen | |
| 2005/0112002 | A1 | 5/2005 | Leu | |
| 2006/0177331 | A1 | 8/2006 | Bergman et al. | |
| 2009/0050635 | A1 | 2/2009 | Richards et al. | |
| 2011/0150681 | A1 | 6/2011 | Obara et al. | |
| 2014/0003986 | A1* | 1/2014 | Elson | F16K 15/148 417/559 |
| 2014/0170006 | A1 | 6/2014 | Bergman et al. | |
| 2015/0219084 | A1* | 8/2015 | Besemer | F04B 39/1066 417/437 |
| 2015/0316044 | A1* | 11/2015 | Lifson | F04B 39/108 417/437 |

FOREIGN PATENT DOCUMENTS

| | | | |
|---|---|---|---|
| DE | 941565 | C | 4/1956 |
| DE | 2545279 | A1 | 4/1977 |
| DE | 4131886 | A1 | 4/1993 |
| EP | 0887551 | A2 | 12/1998 |
| FR | 2605682 | A1 | 4/1988 |
| JP | S59208181 | A | 11/1984 |
| JP | S63076746 | A | 4/1988 |
| JP | H07279849 | A | 10/1995 |
| JP | H08284815 | A | 10/1996 |
| JP | 2005090496 | A | 4/2005 |

OTHER PUBLICATIONS

International Preliminary Report on Patentability regarding International Application No. PCT/US2008/011400, dated Apr. 7, 2010.
Office Action regarding Chinese Patent Application No. 200880108810.1, dated Apr. 26, 2011. Translation provided by Unitalen Attorneys at Law.
Search Report regarding European Patent Application No. 08835757.9, dated Jun. 9, 2011.
Search Report regarding European Patent Application No. 11162102.5, dated Jun. 9, 2011.
Office Action regarding U.S. Appl. No. 12/244,396, dated Aug. 11, 2011.
Office Action regarding U.S. Appl. No. 12/244,396, dated Dec. 12, 2011.
Office Action regarding European Patent Application No. 08835757.9, dated Feb. 22, 2012.
Notice of Allowance regarding U.S. Appl. No. 12/244,396, dated Feb. 23, 2012.
Office Action regarding U.S. Appl. No. 13/036,632, dated Dec. 27, 2012.
Office Action regarding Chinese Patent Application No. 201110091445.1, dated Apr. 28, 2013. Translation provided by Unitalen Attorneys at Law.
Office Action regarding U.S. Appl. No. 13/036,632, dated Jun. 5, 2013.
Office Action regarding U.S. Appl. No. 13/036,632, dated Oct. 7, 2013.
Office Action regarding Chinese Patent Application No. 201110091445.1, dated Dec. 11, 2013. Translation provided by Unitalen Attorneys at Law.
Office Action regarding U.S. Appl. No. 13/036,632, dated Mar. 21, 2014.
Office Action regarding Chinese Patent Application No. 201110091445.1, dated Jun. 5, 2014. Translation provided by Unitalen Attorneys at Law.
Office Action regarding U.S. Appl. No. 13/036,632, dated Nov. 13, 2014.

(56) References Cited

OTHER PUBLICATIONS

Office Action regarding Chinese Patent Application No. 201110091445.1, dated Dec. 31, 2014. Translation provided by Unitalen Attorneys at Law.
Office Action regarding Indian Patent Application No. 537/MUMNP/2010, dated Dec. 31, 2015.
Office Action regarding Indian Patent Application No. 477/MUMNP/2011, dated Jun. 9, 2017.
Office Action regarding U.S. Appl. No. 15/270,458, dated May 23, 2018.
Office Action regarding Chinese Patent Application No. 201610963437.4, dated Jun. 13, 2018. Translation provided by Unitalen Attorneys at Law.
Search Report regarding European Patent Application No. 16196053.9, dated Oct. 1, 2018.
Search Report regarding European Patent Application No. 18193503.2, dated Nov. 19, 2018.
Office Action regarding U.S. Appl. No. 15/270,458, dated Dec. 10, 2018.
Office Action regarding Chinese Patent Application No. 201610963437.4, dated Feb. 1, 2019. Translation provided by Unitalen Attorneys at Law.
Notice of Allowance regarding U.S. Appl. No. 15/270,458, dated Jun. 7, 2019.
Office Action regarding Chinese Patent Application No. 201610963437.4, dated Jul. 31, 2019. Translation provided by Unitalen Attorneys at Law.
Office Action regarding Indian Patent Application No. 477/MUMNP/2011, dated Aug. 29, 2019.

* cited by examiner

CYLINDER HEAD ASSEMBLY FOR RECIPROCATING COMPRESSOR

CROSS-REFERENCE TO RELATED APPLICATIONS

This application is a continuation of U.S. patent application Ser. No. 15/270,458 filed on Sep. 20, 2016, which claims the benefit of U.S. Provisional Application No. 62/248,037 filed on Oct. 29, 2015. The entire disclosures of the above applications are incorporated herein by reference.

FIELD

The present disclosure relates to a cylinder head assembly for a reciprocating compressor.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., refrigerant or carbon dioxide) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a compressor that may include a housing, a piston, and a cylinder head assembly. The housing defines a cylinder, a mounting surface surrounding an opening of the cylinder, and a first valve seat defining a recess extending between the mounting surface and the first valve seat. The piston is disposed within the housing and is movable within the cylinder to define a compression chamber within the cylinder. The cylinder head assembly is mounted on the housing and includes a valve plate, a suction valve, a discharge valve and a head cover. The valve plate may be mounted to the mounting surface and may include a suction plenum, a suction passage providing fluid communication between the suction plenum and the cylinder, a second valve seat through which the suction passage extends, and a discharge passage extending through the valve plate and defined by a third valve seat. The suction valve may be movable between a first suction-valve-position in which the suction valve is seated on the first valve seat to allow fluid flow through the suction passage and a second suction-valve-position in which the suction valve is seated on the second valve seat to restrict fluid flow through the suction passage. The discharge valve is movable between a first discharge-valve-position in which the discharge valve is seated on the third valve seat to restrict fluid flow through the discharge passage and a second discharge-valve-position in which the discharge valve is spaced apart from the third valve seat to allow fluid flow through the discharge passage. The discharge valve may include a valve stem. The head cover may at least partially cover the valve plate and define a discharge chamber that is in selective fluid communication with the compression chamber via the discharge passage. The head cover may include an integrally formed guide post extending into the discharge chamber. The guide post may include a pocket that receives the valve stem for reciprocating motion therein.

In some configurations, the discharge valve includes a head portion that extends radially outward from the valve stem and contacts the third valve seat in the first discharge-valve-position.

In some configurations, the cylinder head assembly includes a spring disposed around the valve stem between the head portion and a distal end of the guide post. The spring may bias the discharge valve toward the first discharge-valve-position.

In some configurations, the cylinder head assembly includes a bushing disposed within the pocket and slidably receiving the valve stem.

In some configurations, the guide post includes an aperture spaced apart from a distal end of the guide post and providing fluid communication between the discharge chamber and the pocket.

In some configurations, the cylinder head assembly includes a gasket disposed between the mounting surface and the valve plate.

In some configurations, the suction valve is an annular member and is disposed entirely between the valve plate and the first valve seat (or between the mounting surface and the first valve seat) in the first suction-valve-position.

In some configurations, the discharge passage is concentric with an aperture extending through the suction valve.

In some configurations, the suction valve includes a plurality of radially extending lobes. The first valve seat may define a plurality of discrete recesses each receiving one of the lobes. The lobes may be the only parts of the suction valve that contact the first valve seat.

In some configurations, the entire suction valve moves (e.g., in a linear path) between the first and second suction-valve-positions.

In some configurations, the suction valve is in the first suction-valve-position when the compressor is shut down.

In some configurations, the housing includes a plurality of cylinders each movably receiving one of a plurality of pistons to form a plurality of compression chambers in selective fluid communication with the discharge chamber and the suction plenum. The cylinder head assembly may include a plurality of suction valves and a plurality of discharge valves.

In another form, the present disclosure provides a compressor that may include a housing, a piston, a valve plate, and a suction valve. The housing may define a cylinder, a mounting surface surrounding the cylinder, and a first valve seat defining at least one recess extending between the mounting surface and the first valve seat. The piston is disposed within the housing and is movable within the cylinder to define a compression chamber within the cylinder. The valve plate may be mounted to the mounting surface and may include a suction plenum, a suction passage providing fluid communication between the suction plenum and the cylinder, a second valve seat through which the suction passage extends, and a discharge passage extending through the valve plate. The suction valve may have an annular main body and a plurality of lobes extending radially outward from the main body. The suction valve may be movable between a first suction-valve-position in which the lobes are seated on the first valve seat to allow fluid flow through the suction passage and a second suction-valve-position in which the main body is seated on the second valve seat to restrict fluid flow through the suction passage.

In some configurations, the suction valve is disposed entirely between the valve plate and the first valve seat (or between the mounting surface and the first valve seat) in the first suction-valve-position.

In some configurations, the first valve seat defines a plurality of discrete recesses each receiving one of the lobes. The lobes may be the only parts of the suction valve that contact the first valve seat.

In some configurations, the entire suction valve moves (e.g., in a linear path) between the first and second suction-valve-positions.

In some configurations, the discharge passage is concentric with an aperture extending through the suction valve.

In some configurations, the suction valve is in the first suction-valve-position when the compressor is shut down.

In some configurations, the compressor may include a discharge valve movable between a first discharge-valve-position in which the discharge valve is seated on a third valve seat defined by the valve plate to restrict fluid flow through the discharge passage and a second discharge-valve-position in which the discharge valve is spaced apart from the third valve seat to allow fluid flow through the discharge passage, the discharge valve including a valve stem; and a head cover at least partially covering the valve plate and defining a discharge chamber that is in selective fluid communication with the compression chamber via the discharge passage, the head cover including an integrally formed guide post extending into the discharge chamber, the guide post including a pocket that receives the valve stem for reciprocating motion therein.

In some configurations, the discharge valve includes a head portion that extends radially outward from the valve stem and contacts the third valve seat in the first discharge-valve-position.

In some configurations, the compressor includes a spring disposed around the valve stem between the head portion and a distal end of the guide post. The spring may bias the discharge valve toward the first discharge-valve-position.

In some configurations, the compressor includes a bushing disposed within the pocket and slidably receiving the valve stem.

In some configurations, the guide post includes an aperture spaced apart from a distal end of the guide post and providing fluid communication between the discharge chamber and the pocket.

In some configurations, the compressor includes a gasket disposed between the mounting surface and the valve plate.

In another form, the present disclosure provides a compressor that may include a housing, a piston, a valve plate, a discharge valve and a head cover. The housing defines a cylinder. The piston is disposed within the housing and is movable within the cylinder to define a compression chamber within the cylinder. The valve plate is mounted to the housing and may include a suction plenum, a suction passage providing fluid communication between the suction plenum and the cylinder, and a discharge passage extending through the valve plate and defined by a discharge valve seat. The discharge valve may be movable between a first discharge-valve-position in which the discharge valve is seated on the discharge valve seat to restrict fluid flow through the discharge passage and a second discharge-valve-position in which the discharge valve is spaced apart from the discharge valve seat to allow fluid flow through the discharge passage. The discharge valve may include a valve stem. The head cover may at least partially cover the valve plate and define a discharge chamber that is in selective fluid communication with the compression chamber via the discharge passage. The head cover may include a guide post extending into the discharge chamber. The guide post may include a pocket that receives the valve stem for reciprocating motion therein.

In some configurations, the guide post may be integrally formed with the head cover.

In some configurations, the guide post includes an aperture spaced apart from a distal end of the guide post and providing fluid communication between the discharge chamber and the pocket.

In some configurations, the discharge valve includes a head portion that extends radially outward from the valve stem and contacts the third valve seat in the first discharge-valve-position.

In some configurations, the compressor includes a spring disposed around the valve stem between the head portion and a distal end of the guide post. The spring may bias the discharge valve toward the first discharge-valve-position.

In some configurations, the compressor includes a bushing disposed within the pocket and slidably receiving the valve stem.

In some configurations, the housing includes a mounting surface surrounding an opening of the cylinder, and a first valve seat defining a recess extending between the mounting surface and the first valve seat, and wherein the valve plate includes a second valve seat through which the suction passage extends.

In some configurations, the compressor includes a suction valve movable between a first suction-valve-position in which the suction valve is seated on the first valve seat to allow fluid flow through the suction passage and a second suction-valve-position in which the suction valve is seated on the second valve seat to restrict fluid flow through the suction passage.

In some configurations, the suction valve is an annular member and is disposed entirely between the valve plate and the first valve seat (or between the mounting surface and the first valve seat) in the first suction-valve-position.

In some configurations, the discharge passage is concentric with an aperture extending through the suction valve.

In some configurations, the entire suction valve moves (e.g., in a linear path) between the first and second suction-valve-positions.

In some configurations, the suction valve includes a plurality of radially extending lobes, wherein the first valve seat defines a plurality of discrete recesses each receiving one of the lobes, and wherein the lobes are the only parts of the suction valve that contact the first valve seat.

In some configurations, the suction valve is in the first suction-valve-position when the compressor is shut down.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
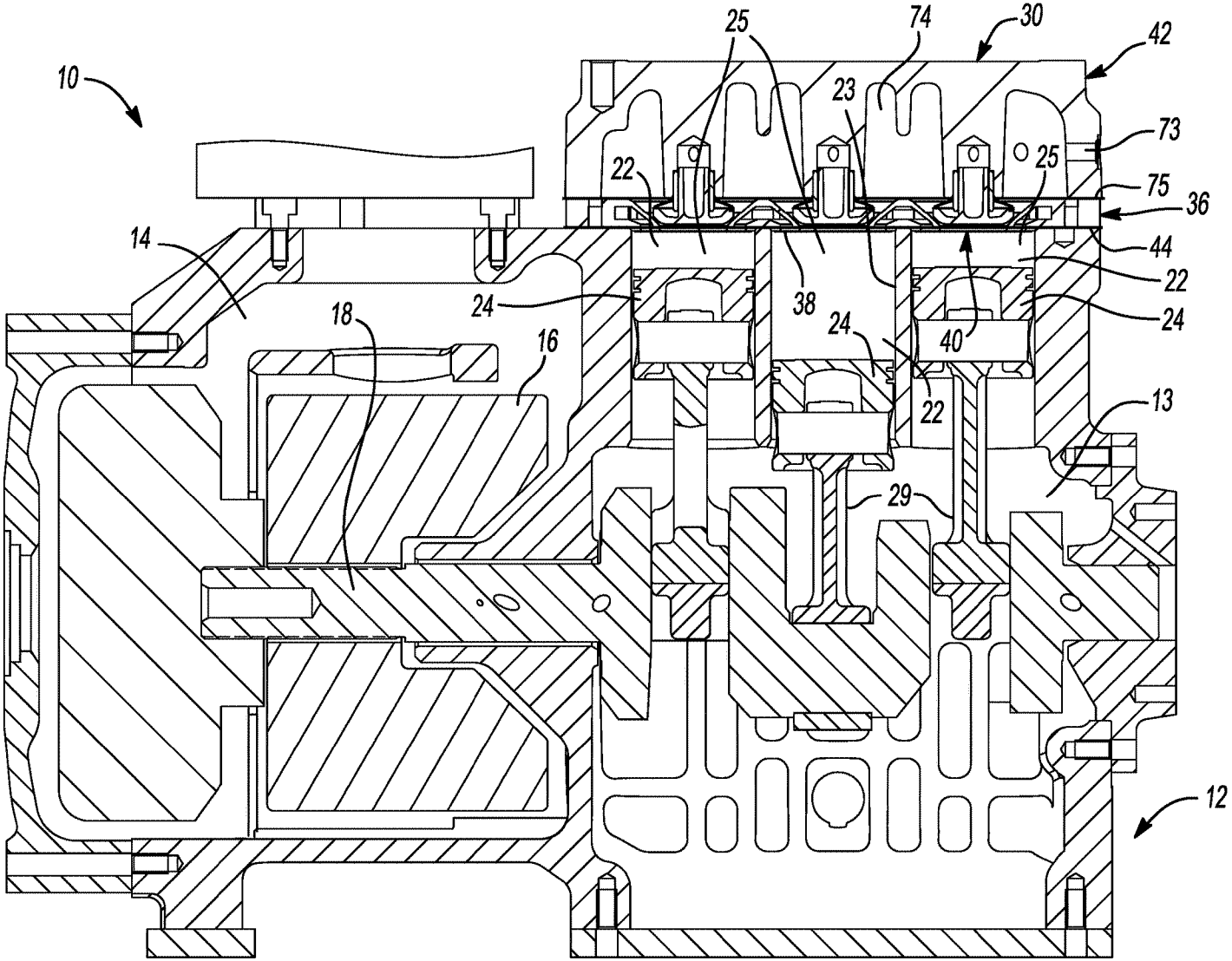
FIG. 1 is a cross-sectional view of a compressor having a cylinder head assembly according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a compressor 10 (e.g., a reciprocating compressor) is provided that may include a shell or housing 12 defining an interior volume 14 in which a motor 16 (shown schematically) and a crankshaft 18 may be disposed. The housing 12 may include one or more cylinders 22 (i.e., cylindrical bores). Each of the cylinders 22 slidably receives a piston 24. Each cylinder 22 and corresponding piston 24 cooperate with a cylinder head assembly 30 to define a compression chamber 25. Piston rings on each piston 24 may sealingly and slidably contact an inner diametrical surface 23 of a corresponding one of the cylinders 22. Each piston 24 is drivingly connected to the crankshaft 18 by a connecting rod 29 so that rotation of the crankshaft 18 (driven by the motor 16) causes the piston 24 to reciprocate within the corresponding cylinder 22.

Figure 2:
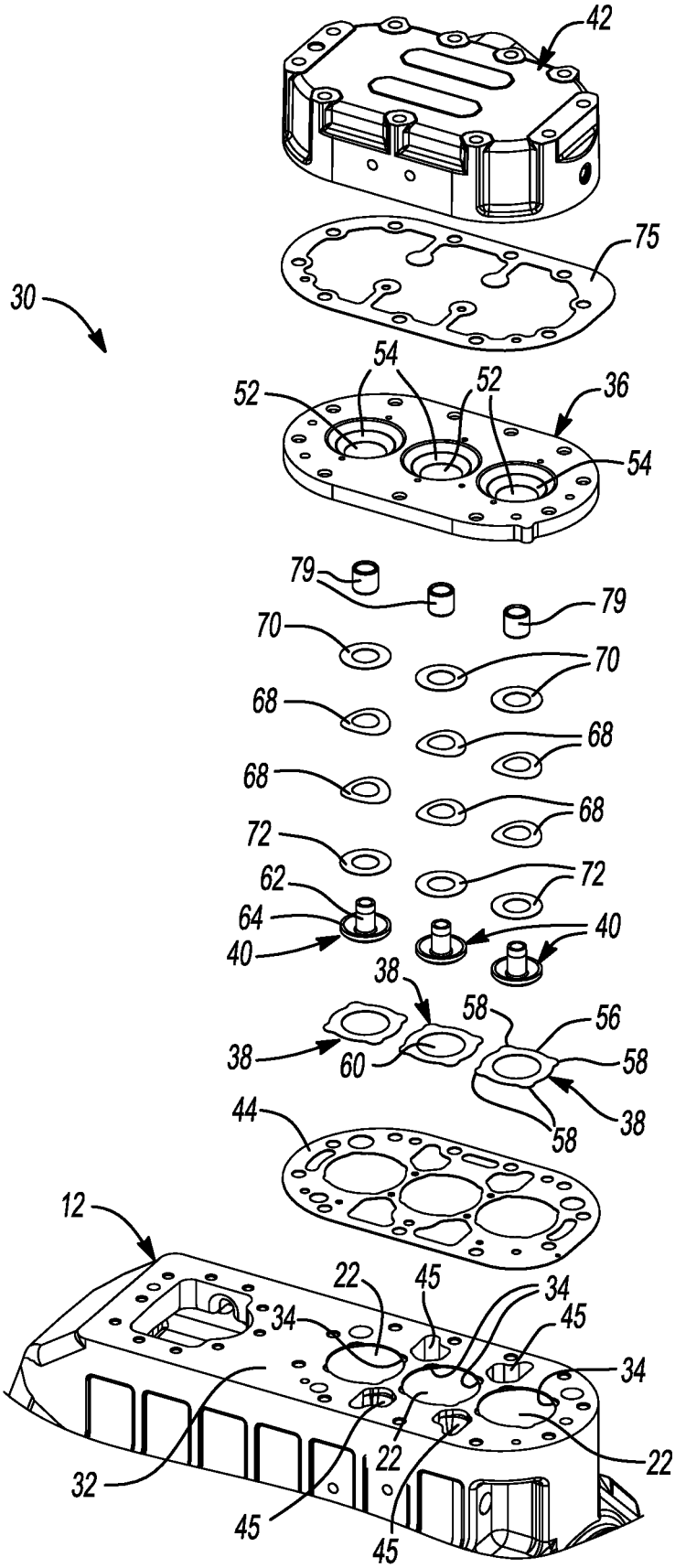
FIG. 2 is an exploded perspective view of the cylinder head assembly.
Figure 5:
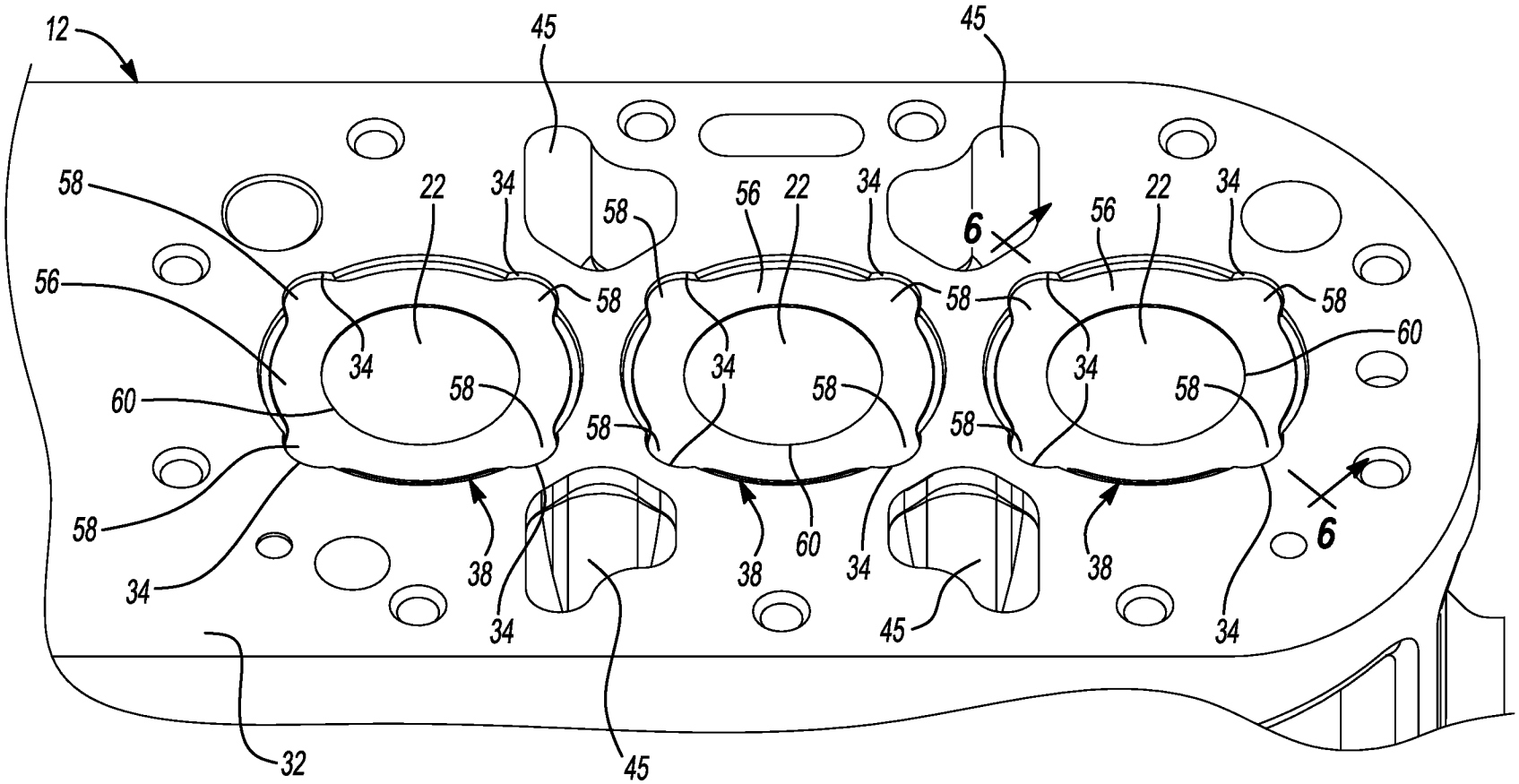
FIG. 5 is a partial perspective view of a compressor housing having suction valves seated thereon.
Figure 6:
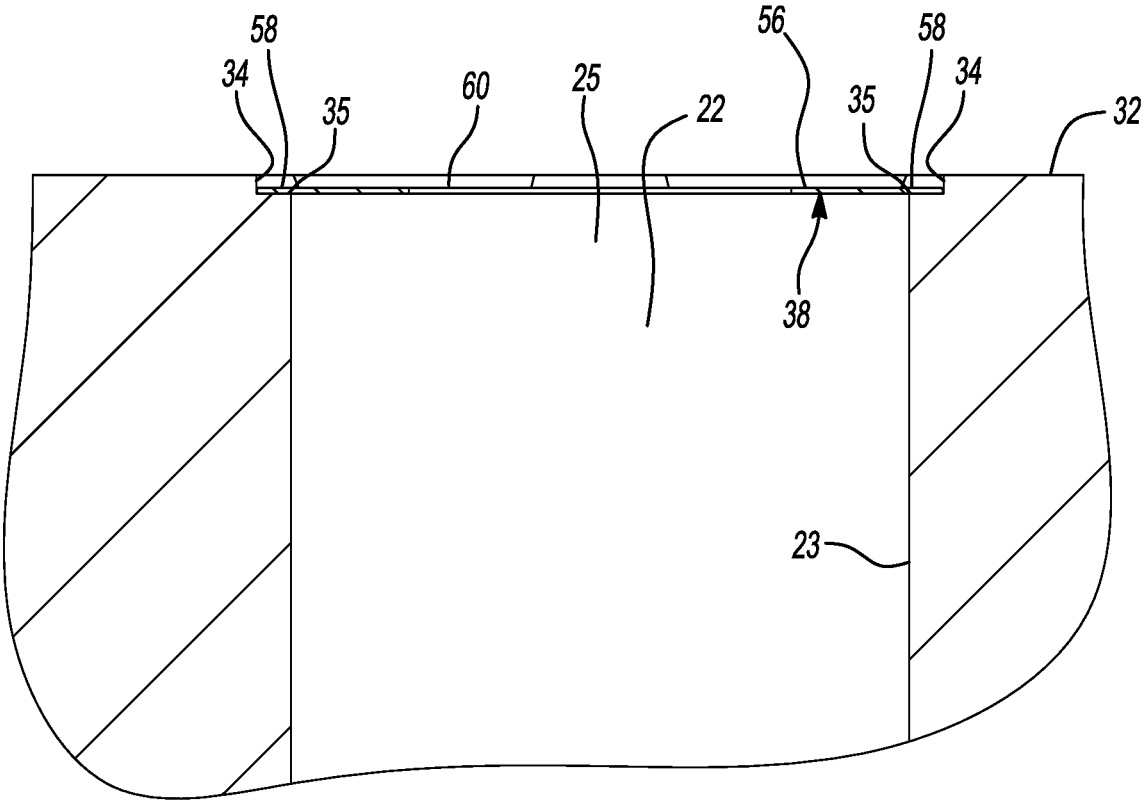
FIG. 6 is a partial cross-sectional view of the housing and a suction valve taken along line 6-6 of FIG. 5.

As shown in FIGS. 2, 5 and 6, the housing 12 may include a mounting surface 32 through which the cylinders 22 extend such that the mounting surface 32 defines openings of the cylinders 22. The cylinder head assembly 30 may be attached to the mounting surface 32 via a plurality of fasteners (not shown), for example. The mounting surface 32 may also define a plurality of recesses 34 that are open to the cylinders 22. The recesses 34 extend radially outward (i.e., in a radial direction relative to longitudinal axes of the cylinders 22) from the inner diametrical surfaces 23 of the cylinders 22. The recesses 34 also extend from the mounting surface 32 in a direction parallel to the longitudinal axes of the cylinders 22. The recesses 34 are defined by ledges 35 that cooperate to define a first valve seat.

Figure 3:
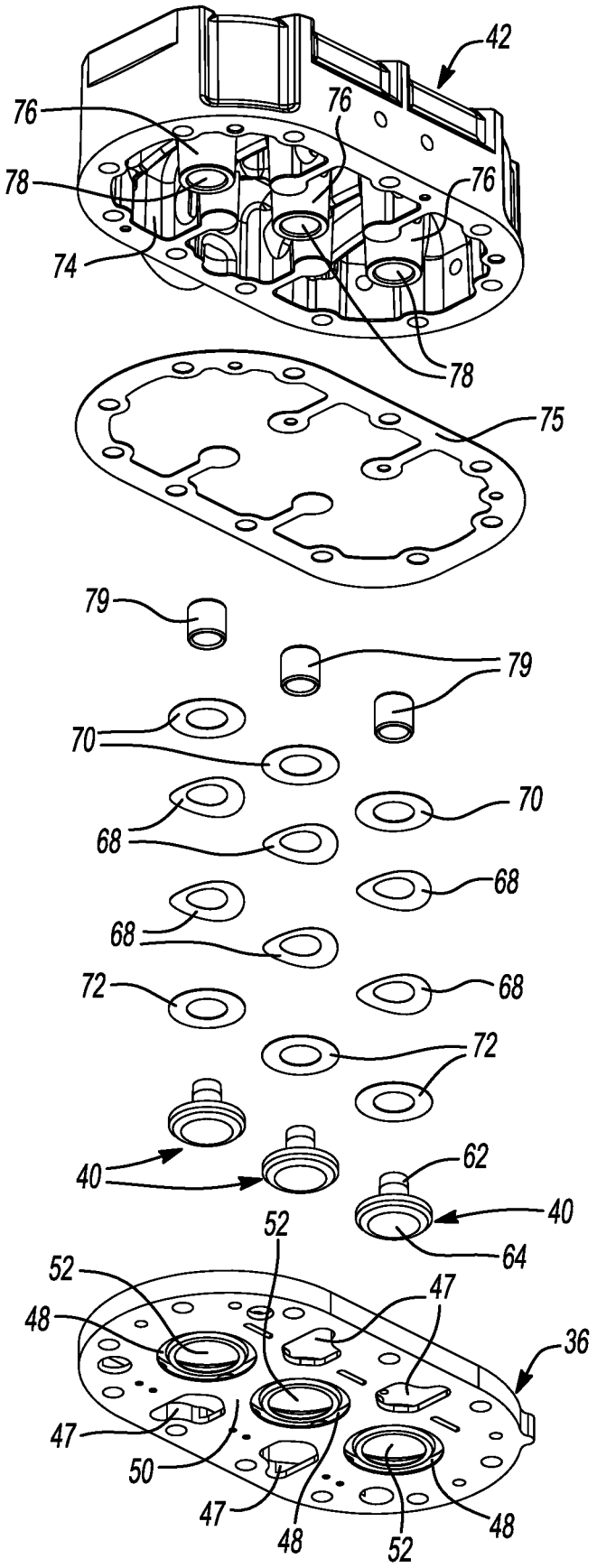
FIG. 3 is another exploded perspective view of the cylinder head assembly.
Figure 4:
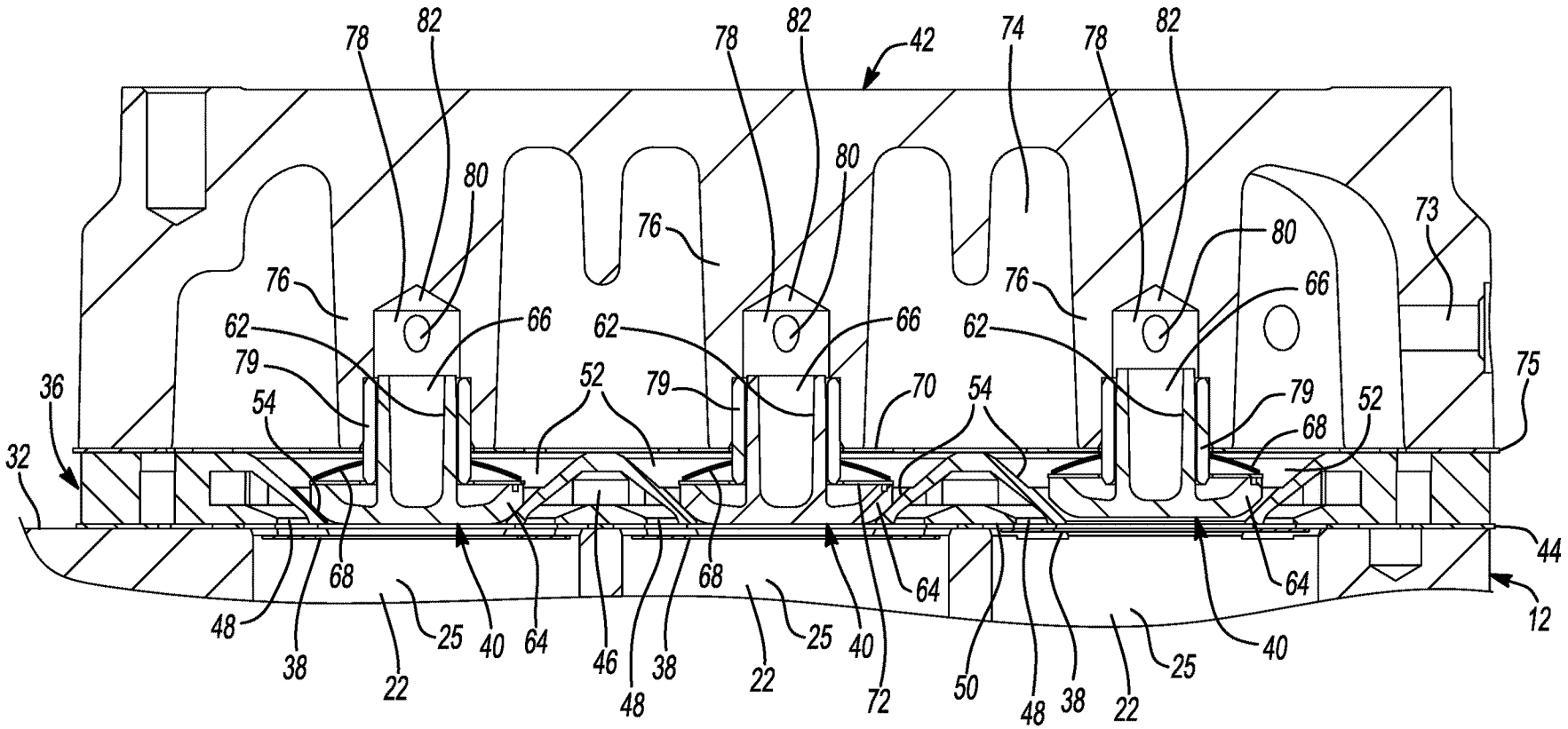
FIG. 4 is a partial cross-sectional view of the cylinder head assembly.

As shown in FIGS. 2-4, the cylinder head assembly 30 may include a valve plate 36, one or more floating suction valves 38, one or more discharge valves 40, and a head cover 42. The valve plate 36 may be mounted to the mounting surface 32 of the housing 12. As shown in FIG. 4, a first gasket 44 may be disposed between the valve plate 36 and the mounting surface 32 to provide a sealed relationship therebetween. The valve plate 36 may include a suction chamber 46, which is an internal cavity that functions as a suction manifold that receives suction-pressure working fluid through suction inlet passages 47 (FIG. 3). The valve plate 36 may include a plurality of annular suction outlet passages 48 (FIGS. 3 and 4). Each suction outlet passage 48 provides fluid communication between the suction chamber 46 and a corresponding one of the cylinders 22. The valve plate 36 includes a lower planar surface 50 (FIGS. 3 and 4) that defines a plurality of second valve seats against which the suction valves 38 can selectively seat to seal off the suction outlet passages 48 from the cylinders 22.

The valve plate 36 may also define a plurality of discharge passages 52 each defined by a corresponding third valve seat 54. Each discharge passage 52 is in selective fluid communication with one of the cylinders 22. The third valve seats 54 may be generally conical surfaces upon which the discharge valves 40 may selectively seat to seal off the discharge passages 52 from the cylinders 22.

As shown in FIGS. 2 and 5, the suction valves 38 may be thin, annular reed valves that include an annular main body 56 and a plurality of lobes 58 that extend radially outward (i.e., relative to longitudinal axes of the cylinders 22) from the main body 56. As shown in FIGS. 5 and 6, at least a portion of each of the lobes 58 may be movably received in a corresponding one of the recesses 34 formed in the housing 12 such that the lobes 58 may contact the ledges 35 to support the suction valve 38 when the suction valve 38 is in an open position (as shown in FIG. 6). As shown in FIG. 4, each suction valve 38 is movable between the open position and a closed position in which the main body 56 sealingly contacts the planar surface 50 of the valve plate 36 to restrict or prevent fluid flow through a corresponding suction outlet passage 48.

An aperture 60 extends through the main body 56 of each suction valve 38. The aperture 60 in each suction valve 38 may be concentrically aligned with a corresponding one of the discharge passages 52 such that working fluid can flow from the cylinders 22 through the apertures 60 and into the discharge passages 52.

While the figures depict each cylinder 22 having a plurality of discrete recesses 34, in some configurations, each cylinder 22 could have a single continuous recess 34 that extends angularly around the inner diametrical surface 23 of the cylinder 22. In such configurations, the suction valves 38 may not include any lobes 58. It will be appreciated, however, that each cylinder 22 could have any number of recesses 34 and the suction valves 38 could have any number of lobes 58. The recesses 34 and lobes 58 can be shaped in any suitable manner.

As shown in FIGS. 2-4, each discharge valve 40 may include a stem portion 62 and a head portion 64. The stem portion 62 may be generally cylindrical and may include a pocket 66 (FIG. 4). The head portion 64 may be disposed on an axial end of the stem portion 62 and may extend radially outward therefrom. The head portion 64 can be generally cup-shaped. As shown in FIG. 4, each discharge valve 40 is movable between a closed position in which the head portion 64 sealingly contacts the corresponding third valve seat 54 (thereby restricting or preventing fluid flow through the discharge passage 52) and an open position in which the head portion 64 is spaced apart from the third valve seat 54 (thereby allowing fluid flow from the cylinder 22 through the discharge passage 52). One or more annular spring members 68 (e.g., wave rings) may be disposed around the stem portion 62 between the head portion 64 and the head cover 42 to bias the discharge valve 40 toward the third valve seat 54. Each discharge valve 40 may also include first and second retainer rings or washers 70, 72 that are disposed around the stem portion 62 and sandwich the one or more spring members 68 therebetween. In some configurations, the discharge valves 40 can be formed from PEEK (polyetheretherketone) or any other suitable material.

The head cover 42 may be mounted to the valve plate 36 and housing 12 such that the valve plate 36 is sandwiched between the head cover 42 and the mounting surface 32 of the housing 12. The head cover 42 may be cast and/or machined as a unitary body and may include a discharge chamber 74 (FIGS. 3 and 4) that receives compressed working fluid (e.g., discharge-pressure working fluid) from the cylinders 22 via discharge passages 52. The compressed working fluid in the discharge chamber 74 may exit the compressor 10 through a discharge port 73 (FIG. 4) in the head cover 42 that may be connected to a condenser or gas cooler (not shown). A second gasket 75 may be disposed between the head cover 42 and the valve plate 36 to seal the discharge chamber 74 from the ambient environment.

The head cover 42 may include a plurality of integrally formed guide posts 76 that extend through the discharge chamber 74. As shown in FIG. 4, each guide post 76 may include a pocket 78 that movably receives the stem portion 62 of a corresponding one of the discharge valves 40 such that the stem portions 62 can reciprocate within the pockets 78 between the open and closed positions of the discharge valves 40. In some configurations, each pocket 78 may fixedly receive a bushing 79 that slidably receives the stem portion 62.

Each guide post 76 may also include an aperture 80 extending therethrough to provide fluid communication between the pockets 78 and the discharge chamber 74. In this manner, discharge-pressure working fluid can fill the spaces extending axially between the stem portions 62 and closed ends 82 of the pockets 78. Such communication between the discharge chamber 74 and the pockets 78 prevents suction within the pockets 78 between the closed ends 82 and the stem portions 62, thereby allowing the discharge valves 40 to more freely move between the open and closed positions. The spring members 68 may be compressed between distal ends 84 of the guide posts 76 and the head portions 64 of the discharge valves 40 to bias the discharge valves 40 toward the closed position. In some configurations, the diameter of the apertures 80 can be adjusted to control the speed at which the discharge valves 40 open and close to improve performance.

With continued reference to FIG. 1-6, operation of the compressor 10 will be described in detail. Suction-pressure working fluid may enter the compressor 10 through a suction port (not shown) in the housing 12. From the suction port, the suction-pressure working fluid may enter a suction plenum 13 (FIG. 1) within the housing 12. From the suction plenum 13, the working fluid may be drawn into the suction chamber 46 in the valve plate 36 via suction passages 45 (FIGS. 2 and 5) in the housing 12 and suction inlet passages 47 in the valve plate 36.

During the suction stroke of one of the pistons 24 within a corresponding cylinder 22 (i.e., while the piston 24 is moving away from the cylinder head assembly 30), low fluid pressure within the compression chamber 25 will cause the suction valve 38 to move into the open position (i.e., where the lobes 58 contact the ledges 35 of recesses 34). Movement of the suction valve 38 toward the open position allows the working fluid in the suction chamber 46 to flow into the compression chamber 25 through the suction outlet passage 48.

Because the outer diameter of the main body 56 of the suction valve 38 is less than the diameter of the cylinder 22 and because the main body 56 has the aperture 60, suction-pressure working fluid from the suction outlet passage 48 can flow around the outside of the main body 56 and through the aperture 60, thereby improving fluid flow into the compression chamber 25. As described above, the suction valves 38 are in the open position at startup of the compressor 10 (i.e., the suction valves 38 are normally open), which improves startup efficiency of the compressor.

The low fluid pressure within the compression chamber 25 during the suction stroke of the piston 24 also causes the discharge valve 40 to move into the closed position (i.e., where the head portion 64 of the discharge valve 40 contacts the third valve seat 54 of the valve plate 36), thereby restricting or preventing fluid flow between the compression chamber 25 and the discharge chamber 74. As described above, the stem portions 62 of the discharge valves 40 move between the open and closed positions within the pockets 78 in the guide posts 76.

The guide posts 76 ensure that the discharge valves 40 seat properly on the third valve seats 54 during the suction stroke. The guide posts 76 allow the discharge valves 40 to move only vertically (i.e., along the longitudinal axes of the cylinders 22) and perpendicular to the mounting surface 32. This ensures proper sealing of the discharge passages 52 and reduces wear on the discharge valves 40 and the third valve seats 54. Furthermore, the construction of the guide posts 76 and the valve plate 36 allow the discharge valves 40 to be adequately retained without fasteners, pins or retainers, thereby simplifying assembly of the compressor 10.

After drawing suction-pressure working fluid into the compression chamber 25 during the suction stroke, the piston 24 moves back toward the cylinder head assembly 30 in a compression stroke. At the start of the compression stroke, increased fluid pressure within the compression chamber 25 (i.e., to a level higher than the fluid pressure within the suction chamber 46) forces the floating suction valve 38 upward toward the valve seat defined by surface 50 of the valve plate 36. As the suction valve 38 moves between the open and closed position, the suction valve 38 is floating, i.e., the suction valve 38 is not retained by any solid structure above or below the suction valve 38. The higher fluid pressure within the compression chamber 25 during the compression stroke will retain the suction valve 38 in contact with the surface 50 to restrict or prevent fluid flow between the compression chamber 25 and the suction chamber 46.

The very short distance that the suction valves 38 must travel between the fully open and fully closed positions allows for nearly instantaneous opening and closing of the suction outlet passages 48, which improves efficiency and performance of the compressor 10. The thin structure and low mass of the suction valves 38 requires less work to move than conventional suction valves, which also improves efficiency and performance of the compressor 10. Furthermore, the manner in which the suction valves 38 interact with the recesses 34 allows the suction valves 38 to be installed and operate without pins, fasteners or retainers. This structure also simplifies manufacturing and assembly of the compressor 10.

Increasing fluid pressure within the compression chamber 25 during the compression stroke of the piston 24 also causes the discharge valve 40 to move into the closed position (i.e., where the head portion 64 of the discharge valve 40 is spaced apart from the third valve seat 54 of the valve plate 36), thereby allowing compressed working fluid in the compression chamber 25 to flow through the discharge passage 52 and into the discharge chamber 74.

While the cylinder head assembly 30 is described above as being incorporated into a reciprocating compressor, it will be appreciated that the valve plate 36, suction valves 38, discharge valves 40 and the head cover 42 could be incorporated into other types of compressors, such as a rotary compressor, for example.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a housing defining a cylinder;

a piston disposed within the housing and movable within the cylinder to define a compression chamber within the cylinder;

a valve plate mounted to the housing and including a discharge valve seat and a discharge passage extending through the valve plate, wherein the discharge passage is defined by the discharge valve seat;

a discharge valve movable between a first discharge-valve-position in which the discharge valve is seated on the discharge valve seat to restrict fluid flow through the discharge passage and a second discharge-valve-position in which the discharge valve is spaced apart from the discharge valve seat to allow fluid flow through the discharge passage, the discharge valve including a valve stem; and a head cover cooperating with the valve plate to define a discharge chamber that is in selective fluid communication with the compression chamber via the discharge passage, wherein a guide post extends from the head cover into the discharge chamber, the guide post including a first pocket that receives the valve stem for reciprocating motion therein, wherein the guide post includes a first aperture spaced apart from a distal end of the guide post and providing fluid communication between the discharge chamber and the first pocket.

2. The compressor of claim 1, wherein the discharge valve includes a head portion that extends radially outward from the valve stem and contacts the discharge valve seat in the first discharge-valve-position.

3. The compressor of claim 2, further comprising a spring disposed around the valve stem between the head portion and a distal end of the guide post, the spring biasing the discharge valve toward the first discharge-valve-position.

4. The compressor of claim 3, wherein the discharge valve includes first and second retainer rings that are disposed around the valve stem and wherein the spring is disposed between and in contact with the first and second retainer rings.

5. The compressor of claim 1, further comprising a bushing disposed within the first pocket and slidably receiving the valve stem.

6. The compressor of claim 1, wherein the housing includes a mounting surface surrounding an opening of the cylinder, and a first valve seat defining a recess extending between the mounting surface and the first valve seat, and wherein the valve plate includes a suction passage and a second valve seat through which the suction passage extends.

7. The compressor of claim 6, further comprising a suction valve movable between a first suction-valve-position in which the suction valve is seated on the first valve seat to allow fluid flow through the suction passage and a second suction-valve-position in which the suction valve is seated on the second valve seat to restrict fluid flow through the suction passage.

8. The compressor of claim 7, wherein the suction valve is an annular member and is disposed entirely between the valve plate and the first valve seat in the first suction-valve-position.

9. The compressor of claim 8, wherein the discharge passage is concentric with a second aperture extending through the suction valve.

10. The compressor of claim 9, wherein the suction valve includes a plurality of radially extending lobes, wherein the first valve seat defines a plurality of discrete recesses each receiving one of the lobes, and wherein the lobes are the only parts of the suction valve that contact the first valve seat.

11. The compressor of claim 1, wherein the guide post is integrally formed with the head cover.

12. The compressor of claim 1, wherein the valve plate defines a suction passage providing fluid communication between a suction plenum and the cylinder.

13. The compressor of claim 1, further comprising a suction valve having an annular main body and a plurality of lobes extending radially outward from the main body.

14. The compressor of claim 13, wherein:

the housing defines a first valve seat, the valve plate includes a suction passage and a second valve seat, the suction passage provides fluid communication between a suction plenum and the cylinder, the suction passage extends through the second valve seat, and the suction valve is movable between a first suction-valve-position and a second suction-valve-position.

15. The compressor of claim 14, wherein:

in the first suction-valve-position, the lobes are out of contact with the second valve seat and are seated on the first valve seat to allow fluid flow through the suction passage, in the second suction-valve-position, the lobes are out of contact with first valve seat, and in the second suction-valve-position, the main body is seated on the second valve seat to restrict fluid flow through the suction passage.

16. The compressor of claim 1, further comprising a crankshaft and a motor, wherein the crankshaft is movably connected to the motor and the piston.

17. The compressor of claim 16, wherein the motor and the crankshaft are disposed within the housing.

18. The compressor of claim 1, wherein the valve stem includes a second pocket that is in fluid communication with the first aperture in the guide post.

* * * * *